US008211081B2

(12) United States Patent
Brandenburger et al.

(10) Patent No.: US 8,211,081 B2
(45) Date of Patent: Jul. 3, 2012

(54) CLOSING CAP FOR CONTAINERS FILLED WITH MEDICAL LIQUIDS

(75) Inventors: Torsten Brandenburger, Niddatal (DE); Ismael Rahimy, Friedberg (DE); Gerald Wegner, Rockenberg (DE)

(73) Assignee: Fresenius Kabi Deutschland GmbH, Bad Homburg (DE)

( * ) Notice: Subject to any disclaimer, the term of this patent is extended or adjusted under 35 U.S.C. 154(b) by 951 days.

(21) Appl. No.: 11/665,911

(22) PCT Filed: Aug. 12, 2005

(86) PCT No.: PCT/EP2005/008787

§ 371 (c)(1),
(2), (4) Date: Jul. 17, 2008

(87) PCT Pub. No.: WO2006/042579

PCT Pub. Date: Apr. 27, 2006

(65) Prior Publication Data

US 2009/0054865 A1 Feb. 26, 2009

(30) Foreign Application Priority Data

Oct. 20, 2004 (DE) ..... 10 2004 051 300

(51) Int. Cl.

| | |
|---|---|
| ***A61M 5/32*** | (2006.01) |
| ***A61B 19/00*** | (2006.01) |
| *B65D 35/00* | (2006.01) |
| *B65D 37/00* | (2006.01) |
| *B65D 47/10* | (2006.01) |
| *B65D 5/72* | (2006.01) |
| *B67D 7/74* | (2010.01) |
| *G01F 11/00* | (2006.01) |

(52) U.S. Cl. ..... 604/415; 604/403; 604/411; 604/414; 604/416; 222/92; 222/129; 222/206; 222/330; 222/541.1; 222/544; 222/566

(58) Field of Classification Search ..... 604/317, 604/403, 408, 410, 411, 415, 416; 222/92, 222/129, 206, 330, 540, 541.1, 544, 566
See application file for complete search history.

(56) References Cited

U.S. PATENT DOCUMENTS

| | | | | |
|---|---|---|---|---|
| 2,804,224 | A * | 8/1957 | Barton | 215/247 |
| 3,758,000 | A * | 9/1973 | Mack | 222/143 |
| 3,900,028 | A | 8/1975 | McPhee | |

(Continued)

FOREIGN PATENT DOCUMENTS

| | | |
|---|---|---|
| CA | 1098084 | 3/1981 |

(Continued)

OTHER PUBLICATIONS

International Search Report (ISR) from PCT/EP2005/008787.

(Continued)

*Primary Examiner* — Leslie Deak
*Assistant Examiner* — Adam Marcetich
(74) *Attorney, Agent, or Firm* — Kenyon & Kenyon LLP

(57) ABSTRACT

The invention relates to a closing cap for containers that are filled with medical liquids. The closing cap includes removal and injection sites. The removal site has a first opening for removing the medical liquid and is obturated by a first pierceable self-sealing membrane. The injection site includes a second opening for injecting an additive and is obturated by a second pierceable self-sealing membrane. The first and second membranes are configured differently.

28 Claims, 2 Drawing Sheets

U.S. PATENT DOCUMENTS

| | | | | | |
|---|---|---|---|---|---|
| 3,904,060 | A | * | 9/1975 | McPhee | 215/251 |
| 3,905,368 | A | * | 9/1975 | Lewis et al. | 604/415 |
| 3,938,519 | A | * | 2/1976 | McPhee | 604/404 |
| 4,153,173 | A | | 5/1979 | Ward et al. | |
| 4,187,149 | A | * | 2/1980 | Tolbert et al. | 435/309.2 |
| 4,227,954 | A | * | 10/1980 | Ward et al. | 156/250 |
| RE31,082 | E | * | 11/1982 | Winchell | 215/232 |
| 4,412,573 | A | * | 11/1983 | Zdeb | 604/415 |
| 4,501,372 | A | | 2/1985 | Hansen | |
| 4,516,977 | A | | 5/1985 | Herbert | |
| 4,547,900 | A | | 10/1985 | Larkin et al. | |
| 4,892,222 | A | * | 1/1990 | Schmidt et al. | 215/247 |
| 5,025,955 | A | * | 6/1991 | Stenger | 222/82 |
| 5,088,995 | A | * | 2/1992 | Packard et al. | 604/415 |
| 5,171,234 | A | * | 12/1992 | Jepson et al. | 604/534 |
| 5,259,843 | A | | 11/1993 | Watanabe et al. | |
| 3,136,440 | A | | 6/1994 | Krug et al. | |
| 5,320,232 | A | * | 6/1994 | Maguire et al. | 215/245 |
| 5,356,018 | A | * | 10/1994 | Dubach | 215/237 |
| 5,678,713 | A | * | 10/1997 | Derksen | 215/249 |
| 5,896,989 | A | | 4/1999 | Ropiak et al. | |
| 6,039,718 | A | | 3/2000 | Niedospial, Jr. | |
| 6,375,028 | B1 | * | 4/2002 | Smith | 220/258.1 |
| 6,868,978 | B2 | | 3/2005 | Amschlinger et al. | |
| 6,893,428 | B2 | | 5/2005 | Willemstyn | |
| 6,904,662 | B2 | * | 6/2005 | Thibault et al. | 29/511 |
| 7,137,519 | B2 | | 11/2006 | Becker | |
| 7,334,310 | B2 | * | 2/2008 | Becker | 29/458 |
| 7,780,636 | B2 | * | 8/2010 | Radmer et al. | 604/192 |
| 7,828,787 | B2 | | 11/2010 | Brandenburger et al. | |
| 2002/0066715 | A1 | * | 6/2002 | Niedospial, Jr. | 215/311 |
| 2003/0075469 | A1 | | 4/2003 | Herbert | |
| 2003/0233083 | A1 | | 12/2003 | Houwaert et al. | |
| 2004/0112855 | A1 | | 6/2004 | Becker | |
| 2005/0215943 | A1 | | 9/2005 | Brandenburger et al. | |
| 2006/0138070 | A1 | * | 6/2006 | Domkowski et al. | 215/247 |
| 2009/0054865 | A1 | | 2/2009 | Brandenburger et al. | |

FOREIGN PATENT DOCUMENTS

| | | | |
|---|---|---|---|
| CA | 2393572 | | 6/2001 |
| CA | 2584384 | | 4/2006 |
| DE | 1498600 | | 3/1970 |
| DE | 2 501 821 | | 1/1975 |
| DE | 2501821 | | 8/1975 |
| DE | 2 909 859 | | 3/1979 |
| DE | 2909859 | | 9/1979 |
| DE | 83 08 416 | | 3/1983 |
| DE | 8308416 | | 6/1983 |
| DE | 3543825 | A1 | 6/1986 |
| DE | 19728775 | A1 | 1/1999 |
| DE | 199 58 952 | | 8/1999 |
| DE | 69416696 | T2 | 9/1999 |
| DE | 102 23 560 | | 1/2001 |
| DE | 19958952 | | 6/2001 |
| DE | 10030474 | C1 | 2/2002 |
| DE | 10223560 | | 12/2003 |
| DE | 102004051300 | | 11/2005 |
| EP | 0 364 783 | | 9/1989 |
| EP | 0 495 330 | A1 | 7/1992 |
| EP | 0 766 955 | | 8/1996 |
| EP | 737058 | B1 | 10/1996 |
| EP | 0766955 | | 4/1997 |
| EP | 1 010 635 | A2 | 6/2000 |
| EP | 1 010 635 | B1 | 3/2003 |
| EP | 1010635 | | 3/2004 |
| GB | 1 469 043 | | 3/1977 |
| GB | 1469043 | | 3/1977 |
| GB | 2 121 016 | A | 12/1983 |
| JP | 54-129795 | | 10/1979 |
| JP | 55-101 758 | | 4/1980 |
| JP | 55-101758 | | 7/1980 |
| JP | 05-022136 | | 1/1993 |
| JP | 05-038694 | | 2/1993 |
| JP | 6-75496 | | 10/1994 |
| JP | 7-27578 | | 5/1995 |
| JP | 08-322909 | | 10/1996 |
| JP | 2004-129867 | | 4/2004 |
| JP | 2004-527408 | | 9/2004 |
| WO | 9517873 | | 7/1995 |
| WO | 9623545 | | 8/1996 |
| WO | WO0160699 | | 8/2001 |
| WO | WO 02/098748 | | 12/2002 |
| WO | WO02098748 | | 12/2002 |
| WO | 03/099191 | | 12/2003 |
| WO | 2005/035032 | | 4/2005 |
| WO | 2006/042579 | | 4/2006 |

OTHER PUBLICATIONS

DIN 58374—Medical infusions equipment—Plastics caps with inserted elastomeric liner for containers manufactured by the blow-fill seal (BFS) process (ISO 15759:2005), May 2006, pp. 1-19.

German-English Dictionary of Engineering and Technology (p. 308).

Opposition to Patent EP 1802535, filed Aug. 18, 2010.

* cited by examiner

CLOSING CAP FOR CONTAINERS FILLED WITH MEDICAL LIQUIDS

FIELD OF THE INVENTION

The present invention relates to a closing cap for a container which is filled with a medical liquid, in particular for infusion or transfusion, in particular a bottle-shaped container filled with a liquid for parenteral feeding. Moreover, the invention relates to a container for a medical liquid for infusion or transfusion, in particular a bottle-shaped container to be filled with a liquid for parenteral feeding, which has one such closing cap.

BACKGROUND OF THE INVENTION

Various containers for medical liquids are known. The containers include on the one hand the known bags comprising multi-layered films, which are distinguished by transparency, flexibility and sealability, and on the other hand the known bottles, which have different shapes. The bags and bottles differ in the design of the accesses for the removal and supply of the medical liquids, which are also referred to as ports.

German patent document DE 102 23 560 A1 describes a bag with a port system, which comprises a removal and injection site. The port system has two separate connectors, one of which is used for the removal of the liquid and the other for the injection of an additive. For the removal of the liquid, use is generally made of a so-called spike, which has a relatively large diameter, whilst for the injection of the additive a cannula is used, which has a relatively small diameter. In this regard, different demands are made on the design of the removal and the injection site.

The known bottles, which represent an alternative to the frequently used bags, are obturated with a cap. Such closing caps are also known as so-called Euro caps, which are standardized in DIN 58374.

There is known from International Publication Number WO 02/098748 A1 a closing cap for a medicine bottle, which closing cap has a removal and injection site. A common membrane made from an elastic material is used to seal the removal and injection site, said membrane being piercable with a piercing part (spike) of an infusion device for removing the medicine and a cannula of a syringe for injecting an additive. The membrane, which is also referred to as a septum, is welded fast to the cap.

A closure for a medicine bottle is also known from European patent document EP 0 364 783 B1. This closure is also characterized by a common septum for the port for removing the medicine and injecting the additive.

The membranes used in medical technology must meet high demands. The membranes should, on the one hand, be able to be pierced with little effort and, on the other hand, the container should be sealed securely. After the puncturing and the removal of the cannula, the membrane for sealing the injection site should be tight. The membrane of the removal site should additionally hold fast the piercing part in the presence of tensile load, so that the piercing part cannot slide out of the piercing site.

A medicine container with a pot-shaped cap, into which two membranes are inserted, is known from European patent document EP 1 010 635 B1. The two membranes are however configured identically.

SUMMARY OF THE INVENTION

An objective of the present invention is to make available a closing cap for containers with a removal and injection site which are filled with medical liquids, in particular liquids for infusion or transfusion, said closing cap permitting reliable handling when removing the medical liquid and injecting the additive.

A further objective of the present invention is to provide a container for a medical liquid, in particular a liquid for infusion or transfusion, with such a closing cap.

According to the closing cap of the present invention, the removal and injection sites are configured as separate accesses with different openings, which are each obturated by a pierceable self-sealing membrane. The closing cap does not therefore have a common membrane for both accesses, but two membranes which are configured differently. In this connection, a different configuration is understood to mean, for example, different shapes or materials.

The decisive advantage of the closing cap, according to the invention, lies in the fact that the use of separate membranes for the removal and injection sites permits optimum adaptation to the different requirements that are made on these accesses. Since the port system has membranes of differing configuration, the removal and injection sites can be adapted in the optimum manner to the specific requirements during the removal of a liquid by means of a piercing part (spike), which has a relatively large diameter, and during the injection of an additive by means of a cannula, which has a relatively small diameter.

The membrane of the removal site can be configured in such a way that the port can be pierced with a piercing part (spike), the spike being held fast in the presence of tensile load and the removal site being securely sealed, whilst the membrane of the injection site can be designed in such a way that the port is tight after puncturing and removal of the cannula.

According to a preferred embodiment of the closing cap, both membranes are held in a clamped manner in the cap. The membranes can also be elastically deformed. The assembly of the closing cap can therefore take place in a straightforward manner solely by pressing of the individual parts. It is however also possible for the membranes to be welded and/or glued to the cap.

Another preferred embodiment makes provision such that the openings for the membranes are recesses in the lid part of the cap, in which the membranes are inserted in a matching fashion. The form-fit connection guarantees that the membranes have a secure hold.

According to a particularly preferred embodiment, a retaining plate, with which the membranes are clamped, is arranged at the inside of the lid part of the cap. For this purpose, the retaining plate preferably has shoulders engaging beneath the membranes.

Another alternative embodiment provides for shoulders engaging beneath the membranes, which shoulders are provided not on the retaining plate, but at the inside of the lid part. The shoulders are preferably in one piece with the lid part. The assembly can be further simplified if the shoulders are flexible parts. The membranes then merely have to be inserted into the lid part and the shoulders turned up. The shoulders are preferably configured as annular flanges, which offer a secure hold.

According to a further particularly preferred embodiment, the retaining plate is inserted into the closing cap in a lock-in or snap-in manner. For the fitting, the membranes are inserted into the lid part and then the retaining plate into the side part of the cap.

The retaining plate can however also be in one piece with the side part, the lid part being configured as a cap body which can be folded down from the side part. The membranes are then inserted into the folded-down cap body and the cap body is then folded onto the retaining plate, so that the membranes are clamped between the cap body and the retaining plate.

The cap body is preferably fixed with a hinge to the side part. Such hinges are known as so-called film hinges in plastics technology.

The first and/or second openings in the cap are preferably obturated with a twist-off part, which forms as it were an originality seal. The handling is preferably improved by the fact that the twist-off parts are configured as flat grip parts. The twist-off parts expediently each have a marking, in particular a recess configured in the manner of an arrow. Since the arrows point in opposite directions to one another, it can immediately be recognized that the given port is a removal site or an injection site.

The self-sealing membrane of the removal site preferably has an outer annular portion, which is followed by a middle annular portion with an upper and lower seating face, said middle annular portion being held in a clamped manner in the cap. The middle annular portion transforms into an inner plate-shaped portion, at the upper side of which a trough-shaped recess is formed. The inner plate-shaped portion preferably has a flat underside. The special configuration of the membrane ensures on the one hand that the spike is guided and held securely when piercing the membrane and on the other hand guarantees that, after withdrawal of the spike, the membrane reliably seals again even in the presence of relatively high internal pressure in the container. It has been shown in tests that the special configuration of the membrane is decisive for the immediate re-sealing, the sealing of the membrane being increased further with increasing internal pressure in the packaging.

The membrane of the removal site is preferably weakened, so that it can easily be pierced with a spike. The membrane is preferably pre-slit in the form of a cross. It can however also be slit in the shape of a star or be provided only with a single slit.

The membrane of the injection site differs from the membrane of the removal site by its cross-section in the centre. The membrane of the injection site preferably has a larger cross-section than the membrane of the removal site, i.e. one membrane is thicker in the centre than the other membrane.

The membrane of the injection site also preferably has an outer annular portion. The outer annular portion, however, is directly followed by the inner plate-shaped portion, trough-shaped recesses being formed both at the upper side and the lower side of the inner plate-shaped portion. A high degree of tightness is achieved with the special geometry of the membrane.

The, in particular, bottle-shaped container according to the invention for medical liquids can have different shapes. Apart from round shapes, oval or flattened shapes are also possible.

DETAILED DESCRIPTION OF THE DRAWINGS

In the following exemplary embodiments a device in accordance with the present invention is explained in greater detail by reference to the figures.

Figure 1:
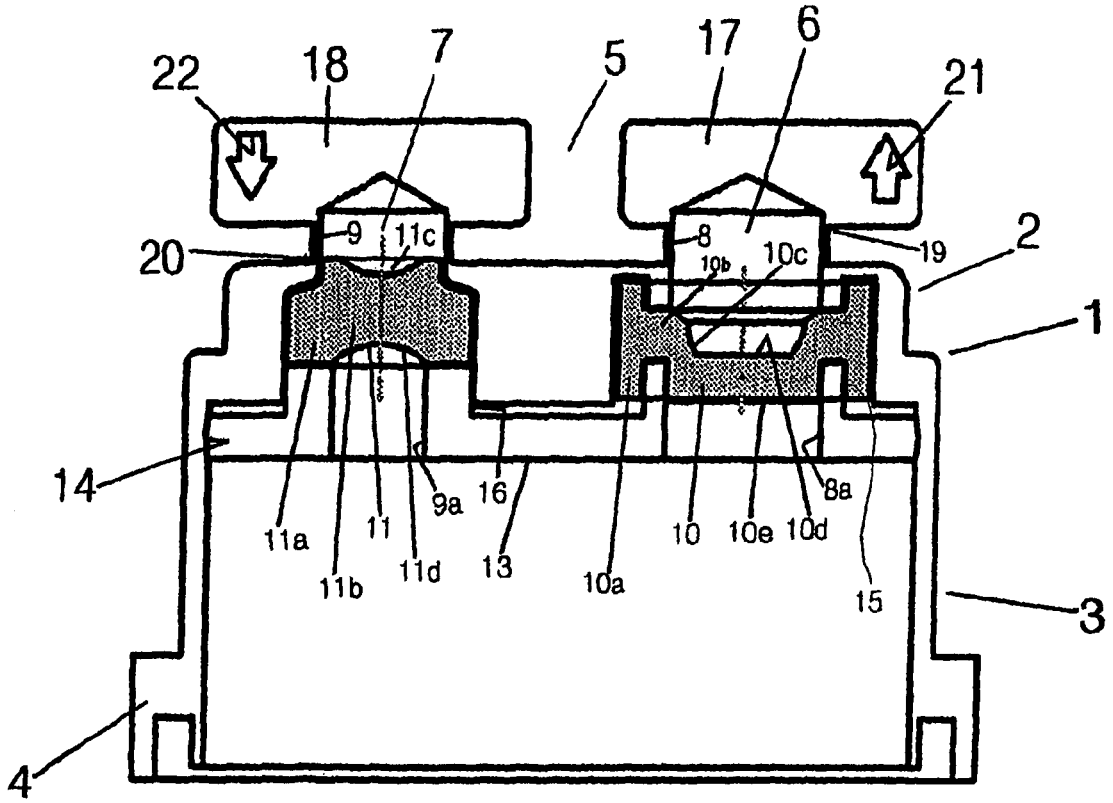
FIG. 1 shows a first example of an embodiment of the closing cap according to the invention in a cut-away view.

FIG. 1 shows a first example of an embodiment of the closing cap according to the invention for bottle-shaped containers, in particular bottles filled with a liquid for parenteral feeding. The closing cap is an injection-moulded part, which is preferably produced from polyolefins, in particular PP, PE, PET and blends.

Closing cap 1 has a round lid part 2, which is followed by a cylindrical side part 3. Located at the lower edge of side part 3 is a flange 4 for fixing the cap to the head of a bottle. Lid part 2 has a larger wall thickness than side part 3.

Cap 1 has a port system 5 with a removal site 6 and an injection site 7. The port system is described in detail below.

Lid part 2 of cap 1 has two openings 8, 9 with a preferably circular cross-section, said openings being arranged at a distance from one another. A first self-sealing membrane 10 for removal site 6 sits in first opening 8 and a second self-sealing membrane 11 for the injection site in second opening 9. The two membranes are configured differently. They are made from an elastic material, preferably from a synthetic rubber, preferably from polyisoprene.

First membrane 10 for removal site 6 has an outer annular portion 10*a*, which is followed by a middle annular portion 10*b*, which has a smaller diameter than the outer portion. Middle annular portion 10*b*, which has an upper and lower seating face, is held in a clamped manner in the cap. Middle annular portion 10*b* transforms into an inner plate-shaped portion 10*c*, at the upper side of which an upper mould-shaped recess 10*d* is formed. Plate-shaped portion 10*c* has a flat underside 10*e*. The plate-shaped portion is pre-slit in the form of a cross or star in the centre of trough-shaped recess 10*d*, in such a way that the elastic material is weakened, but not severed.

Second membrane 11 for injection site 7, which is thicker than first membrane 10, has an outer annular portion 11*a* with an upper and lower seating face, said outer annular portion being held in a clamped manner in the cap. Annular portion 11*a* is followed directly by an inner plate-shaped portion 11*b*, at the upper and lower side of which an upper and a lower trough-shaped recess 11*c*, 11*d* are formed. Trough-shaped recesses 11*c* and 11*d* of second membrane 11 have a smaller depth than trough-shaped recess 10*d* of first membrane 10.

The two membranes 10, 11 are held in a clamped manner by means of a retaining plate 13, which is inserted in a snap-in or lock-in manner into side part 3 of the cap. The edge of retaining plate 13 sits in an annular groove 14, which runs at the inside of side part 3 beneath lid part 2.

In the region of openings 8, 9, lid part 2 of cap 1 has a shape complementary to membranes 10, 11, so that the membranes sit in a matching fashion in the lid part. The membranes are supported with the upper seating faces at the underside of lid part 2.

Retaining plate 13 has two openings 8*a* and 9*a*, which have the same or a larger diameter than corresponding openings 8 and 9 of lid part 2. Openings 8*a* and 9*a* are surrounded by annular shoulders 15, 16, which lie adjacent to the lower seating faces of membranes 10, 11.

For the assembly, membranes 10, 11 are inserted into openings 8, 9 of lid part 2 of cap 1. Retaining plate 13 is then inserted into cap 1, so that membranes 10, 11 are clamped between the lid part and the retaining plate.

Removal site 6 and injection site 7 of the cap are each obturated with a twist-off part 17, 18, which forms an originality seal. Both twist-off parts 17, 18 are configured as flat grip parts, which are each connected via a circular rupture zone 19, 20 to lid part 2. These grip parts can easily be twisted off by hand. Grip part 17 has a recess 21 configured in the manner of an arrow which points upwards, whilst grip part 18 has a recess 22 configured in the manner of an arrow which points downwards. As a result, it becomes clear that removal site 6 is exposed after twisting off grip part 17 and the injection site after twisting off grip part 18.

For the removal of a medical liquid, grip part 17 of removal site 6 is twisted off and a piercing part (not shown), for example a spike of a transfusion device for enteral nutritive solutions or an infusion device, is introduced into opening 8 of lid part 2. Pre-slit membrane 10 is thereby pierced, so that access to the container is produced.

For the injection of an additive, grip part 18 is snapped off and the cannula of a syringe is pierced into membrane 11 of injection site 7.

Figure 2:
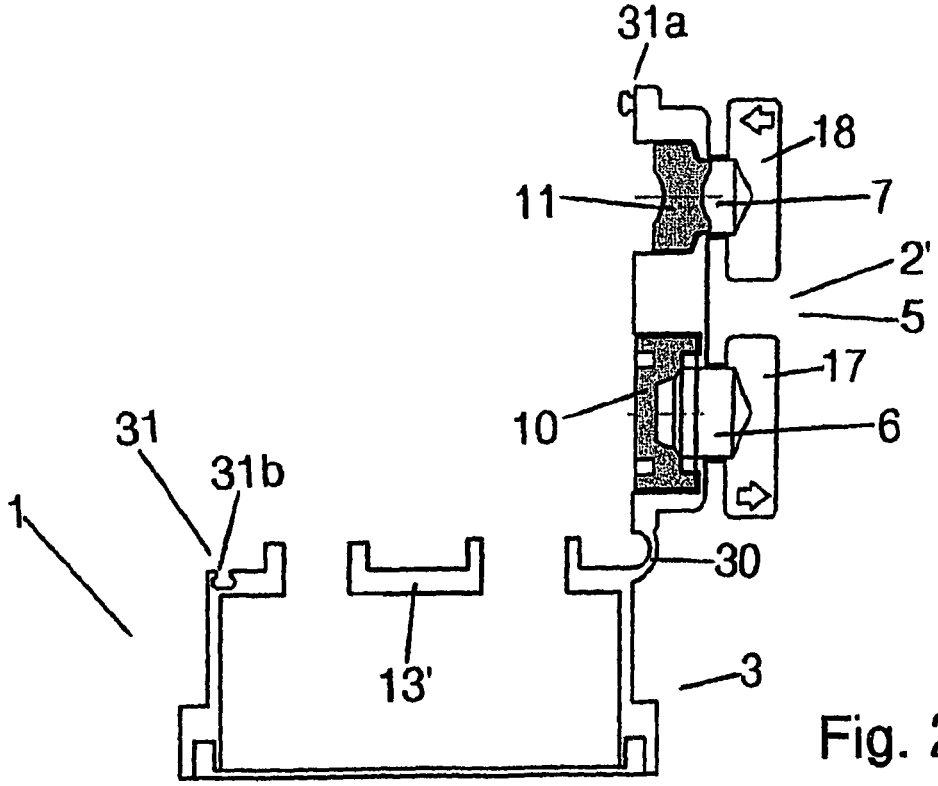
FIG. 2 shows an alternative embodiment of the cap from FIG. 1.

FIG. 2 shows an alternative embodiment of the example of embodiment described by reference to FIG. 1. The closing cap of FIG. 2 differs from the cap of FIG. 1 solely in that lid part 2' is configured as a fold-down cap body and retaining plate 13' is in one piece with the cap. Otherwise, the two caps have the same configuration. The same reference numbers are therefore also used for the parts corresponding to one another.

Lid part 2' of cap 1' from FIG. 2 is fixed to the edge of side part 3 by means of a film hinge 30, which extends only over a part of the circumference of the cap. Lying diametrically opposite film hinge 30 is a snap connection 31, which also extends only over a part of the circumference of the cap. Snap connection 31 is formed by a projecting lug 31*a* at the edge of lid part 2' and an undercut groove 31*b* at the edge of side part 3.

For the assembly of the cap, the two membranes 10, 11 are inserted into folded-down lid part 2', and lid part 2' is folded onto retaining plate 13', lug 31*a* being snapped into groove 31*b*. The membranes are again clamped between the retaining part and the lid part.

Figure 3A:
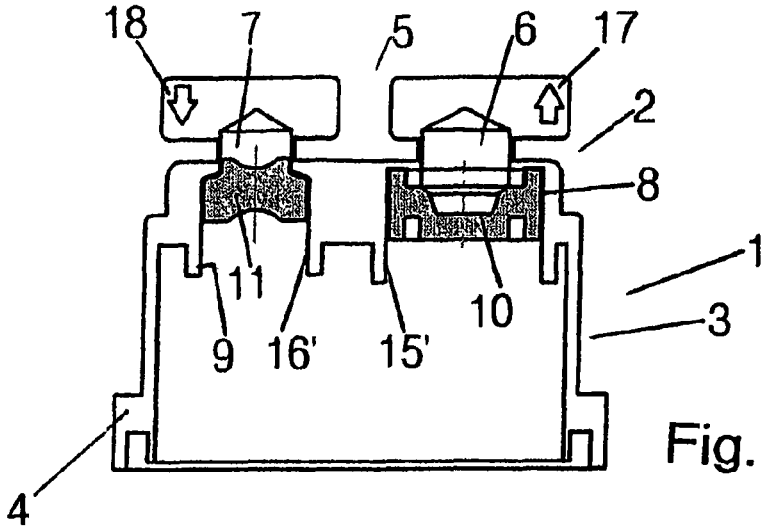
FIG. 3*a* shows a further example of embodiment of the cap according to the invention before the fixing of the membranes in the lid part.
Figure 3B:
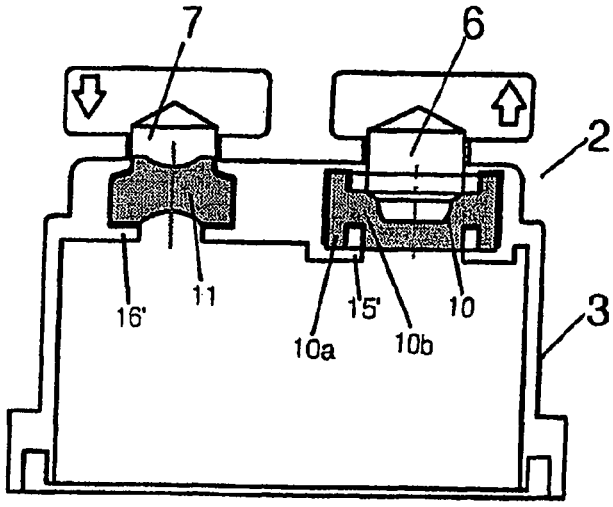
FIG. 3*b* shows the cap from FIG. 3*a* after the fixing of the membranes.

FIGS. 3*a* and 3*b* show a further example of embodiment of the closing cap, which differs from the embodiments described by reference to FIGS. 1 and 2 in that a retaining plate is not provided. The parts corresponding to another are again designated with the same reference numbers.

Shoulders 15', 16' for clamping membranes 10, 11 are annular sleeves at the underside of lid part 2, the diameter of which sleeves corresponds to the diameter of openings 8, 9. Sleeve-shaped shoulder 15' of removal site 6 has a greater length than shoulder 16' of injection site 7.

Membranes 10, 11 are first inserted into openings 8, 9 (FIG. 3*a*). Shoulders 15', 16' are then turned up in such a way that they lie adjacent to the lower seating faces of the membranes, so that the membranes are held in a clamped manner. In the case of membrane 11 of injection site 7, it is sufficient to bend shoulder 16' through 90°. Shoulder 15' of removal site 6, on the other hand, is flanged around outer annular portion 10*a* of the membrane (FIG. 3*b*).

Figure 4:
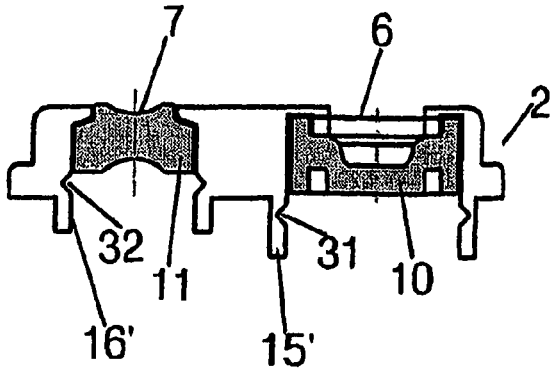
FIG. 4 shows a further example of embodiment of the cap.

FIG. 4 shows the lower portion of the lid part of the cap of a further example of embodiment, which differs from the other embodiments in that an annular groove 31, 32 is provided in the region in which shoulders 15', 16' are folded up. Since the shoulders are weakened in this region, the folding-up of the same is made easier.

Figure 5:
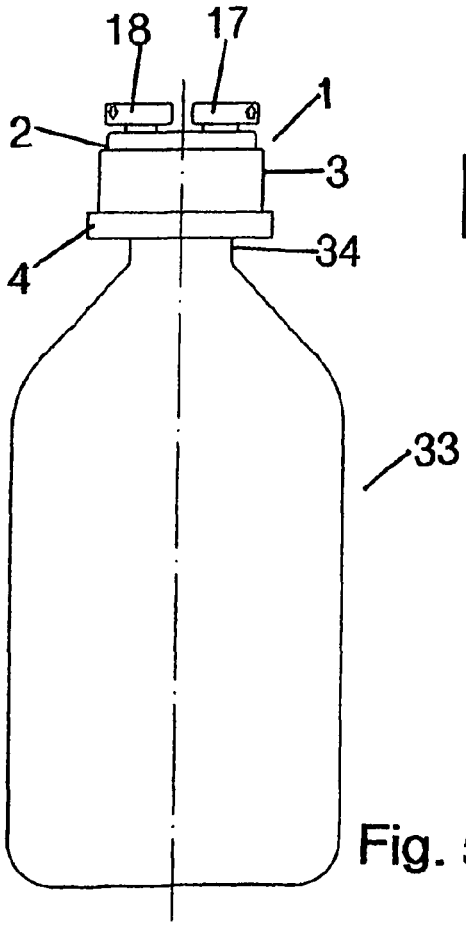
FIG. 5 shows the cap-type container according to the invention, which is obturated with the cap according to the invention.

FIG. 5 shows a bottle-shaped container 33 which is obturated with closing cap 1. Closing cap 1 is welded fast to head 34 of bottle. A rubber gasket (not shown) sits between closing cap 1 and bottle head 34. The container is filled with a liquid for parenteral feeding. The container can however also be filled with an infusion or transfusion solution.

The invention claimed is:

1. A closing cap for containers filled with medical liquid, comprising:

a removal site configured to remove the medical liquid;

an injection site configured to inject an additive, wherein the removal site and the injection site are configured as separate accesses, the removal site configured to provide access to a first opening for removing the liquid, and the injection site configured to provide access to a second opening for injecting the additive;

a first pierceable self-sealing membrane within the first opening, and a second pierceable self-sealing membrane within the second opening, the first and second pierceable membranes having different configurations; and shoulders for engaging beneath at least one of the first and second membranes, said shoulders having a first position for receiving the at least one of the first and second membranes, and a second position for anchoring the at least one of the first and second membranes.

2. The closing cap according to claim 1, wherein at least one of the first membrane and the second membrane are held in a clamped manner.

3. The closing cap according to claim 1, further comprising:

a lid part; and a side part, wherein the first and second openings are recessed in the lid part.

4. The closing cap according to claim 3, wherein the shoulders are arranged at the inside of the lid part.

5. The closing cap according to claim 4, wherein the first position is a first straight configuration for inserting the first and second membranes and the second position is a second folded configuration for holding the first and second membranes in a clamped manner.

6. The closing cap according to claim 4, wherein the shoulders and the lid part are one piece.

7. The closing cap according to claim 4, wherein the shoulders are configured as an annular flange.

8. The closing cap according to claim 1, wherein at least one of the first and second openings are obturated with a twist-off part.

9. The closing cap according to claim 8, wherein the twist-off part is configured as a flat grip part.

10. The closing cap according to claim 1, wherein the first membrane has a trough-shaped recess on its upper side.

11. The closing cap according to claim 10, wherein the first membrane has an outer annular portion and a middle annular portion, the middle annular portion having an upper and lower seating face and an inner plate-shaped portion in which the upper mould-shaped recess is formed, the middle annular portion held in a clamped manner in the cap.

12. The closing cap according to claim 11, wherein the inner plate-shaped portion has a flat underside.

13. The closing cap according to claim 11, wherein the middle annular portion has a smaller cross-section than the outer annular portion.

14. The closing cap according to claim 1, wherein the first membrane has a smaller cross-section in the centre than the second membrane.

15. The closing cap according to claim 1, wherein the first membrane is weakened.

16. The closing cap according to claim 15, wherein the first membrane is pre-slit.

17. The closing cap according to claim 1, wherein the second membrane includes trough-shaped recesses on its upper side and lower side.

18. The closing cap according to claim 17, wherein the second membrane has an outer annular portion with an upper and lower seating face and an inner plate-shaped portion, in which the trough-shaped recesses on the upper side and lower side are formed, the outer annular portion held in a clamped manner in the cap.

19. The closing cap according to claim 1, wherein at least one of the first and second membranes are made from a synthetic rubber.

20. The closing cap according to claim 19, wherein at least one of the first and second membranes are made of polyisoprene.

21. The closing cap according to claim 1, wherein the cap is an injection-moulded part.

22. The closing cap according to claim 21, wherein the cap is made of polyolefin.

23. The closing cap according to claim 1, wherein the first membrane and the second membrane are separated from each other by a central portion of the cap.

24. A closing cap for containers filled with medical liquid, comprising:

a removal site configured to remove the medical liquid;

an injection site configured to inject an additive, wherein the removal site and the injection site are configured as separate accesses, the removal site configured to provide access to a first opening for removing the liquid, and the injection site configured to provide access to a second opening for injecting the additive;

a first pierceable self-sealing membrane within the first opening, and a second pierceable self-sealing membrane within the second opening, the first and second pierceable membranes having different configurations;

a lid part, wherein the first and second openings are recessed in the lid part;

a side part; and a retaining plate arranged at the inside of the lid part, the first and second membranes clamped to the retaining plate, wherein the retaining plate is inserted into the cap in a lock-in or snap-in manner, or the retaining plate and the side part are one piece and the lid part is configured as a cap body that is foldable down from the side part.

25. The closing cap according to claim 24, wherein the retaining plate includes shoulders engaging beneath at least one of the first and second membranes.

26. The closing cap according to claim 24, wherein the lid part is fixed with a hinge to the side part.

27. The closing cap according to claim 24, wherein said retaining plate is arranged in an annular groove at the inside of the side part.

28. A container for medical liquids, comprising:

a bottle-shaped structure; and a closing cap attachable to the bottle-shaped structure, the closing cap including:

a removal site configured to remove the medical liquid and an injection site configured to inject an additive, wherein the removal site and the injection site are configured as separate accesses, the removal site configured to provide access to a first opening for removing the liquid, the first opening obturated by a first pierceable self-sealing membrane, and the injection site configured to provide access to a second opening for injecting the additive, the second opening obturated by a second pierceable self-sealing membrane, the first and second pierceable membranes having different configurations; and shoulders for engaging beneath at least one of the first and second membranes, said shoulders having a first position for receiving the at least one of the first and second membranes, and a second position for anchoring the at least one of the first and second membranes.

* * * * *